US009636910B2

(12) United States Patent
Ohtaka et al.

(10) Patent No.: US 9,636,910 B2
(45) Date of Patent: May 2, 2017

(54) PRINTER

(71) Applicant: RISO KAGAKU CORPORATION, Tokyo (JP)

(72) Inventors: Satoshi Ohtaka, Ibaraki (JP); Tomoki Matsumura, Ibaraki (JP); Naoto Tajima, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/719,961

(22) Filed: May 22, 2015

(65) Prior Publication Data

US 2015/0343765 A1 Dec. 3, 2015

(30) Foreign Application Priority Data

May 30, 2014 (JP) ..... 2014-112015
May 21, 2015 (JP) ..... 2015-103422

(51) Int. Cl.
*B41J 29/393* (2006.01)
*B41J 2/045* (2006.01)
(Continued)

(52) U.S. Cl.
CPC ..... *B41J 2/04548* (2013.01); *B41J 2/01* (2013.01); *B41J 2/17503* (2013.01); *B41J 2/17546* (2013.01); *B41J 29/393* (2013.01)

(58) Field of Classification Search
CPC ..... B41J 2/17546; B41J 2/195
(Continued)

(56) References Cited

U.S. PATENT DOCUMENTS 6,371,586 B1 4/2002 Saruta
6,923,531 B2 8/2005 Saruta
(Continued)

FOREIGN PATENT DOCUMENTS

CN 1257007 6/2000
CN 1423429 6/2003
(Continued)

OTHER PUBLICATIONS

Search Report issued in European Patent Office (EPO) Patent Application No. 15169592.1, dated Oct. 11, 2016.
(Continued)

*Primary Examiner* — Julian Huffman
(74) *Attorney, Agent, or Firm* — Greenblum & Bernstein, P.L.C.

(57) ABSTRACT

A printer includes an expendable supply, a detector that detects at least one of a power-on operation, a resume from an energy-saving mode and a new installation of an expendable supply, a determiner that determines whether or not a recommended limit of the expendable supply has passed, a warning generator that generates a warning for notifying that a usable limit of the expendable supply will come soon if the recommended limit has already passed, and a memory storage that stores a warning cycle and a last warning generation. When the recommended limit has passed and the power-on operation, the resume or the new installation is detected, the warning generator generates a warning [1] when the last warning generation is not stored in the memory storage, or [2] when the last warning generation is stored in the memory storage and the warning cycle has elapsed from the last warning generation.

12 Claims, 7 Drawing Sheets

(51) Int. Cl.
*B41J 2/01* (2006.01)
*B41J 2/175* (2006.01)

(58) Field of Classification Search
USPC ..... 347/19, 86
See application file for complete search history.

(56) References Cited

U.S. PATENT DOCUMENTS

| | | | | |
|---|---|---|---|---|
| 7,280,243 | B2 | 10/2007 | Kai | |
| 7,370,930 | B2 | 5/2008 | Kosugi | |
| 7,595,908 | B2 | 9/2009 | Kai | |
| 7,884,967 | B2 | 2/2011 | Kai | |
| 9,016,843 | B2 | 4/2015 | Nishiyama et al. | |
| 2002/0085051 | A1 | 7/2002 | Saruta | |
| 2003/0058297 | A1 | 3/2003 | Saruta | |
| 2003/0128248 | A1* | 7/2003 | Kosugi | B41J 2/17503 347/19 |
| 2003/0210426 | A1 | 11/2003 | Kai | |
| 2004/0032442 | A1* | 2/2004 | Phillips | B41J 2/17546 347/19 |
| 2004/0168116 | A1 | 8/2004 | Shikata | |
| 2005/0073393 | A1 | 4/2005 | Motosugi et al. | |
| 2008/0212125 | A1 | 9/2008 | Kai | |
| 2009/0296125 | A1 | 12/2009 | Kai | |

FOREIGN PATENT DOCUMENTS

| | | |
|---|---|---|
| CN | 1456440 | 11/2003 |
| JP | 3951996 | 8/2007 |

OTHER PUBLICATIONS

Office Action issued in China Counterpart Patent Appl. No. 201510291011.4, dated Jul. 25, 2016.

* cited by examiner

PRINTER

BACKGROUND OF THE INVENTION

Technical Field

The present invention relates to a printer, and to an expendable supply for a printer.

Background Arts

An inkjet printer is generally provided with replaceable ink cartridges which contain inks by color. Inks are supplied from the ink cartridges to inkjet heads, and then ejected onto a print sheet from nozzles of the inkjet heads to form images, texts or the like on the print sheet.

For an expendable supply such as an ink cartridge, a validity date (usable period) is generally set as a limit date of a quality assurance period. Therefore, a general inkjet printer calculates a validity date (usable limit) of an ink cartridge based on its production date stored in the ink cartridge and a period while the ink cartridge is used, and shows a warning, if the calculated validity date of the currently-used ink cartridge is expired.

Japanese Granted Patent No. 3951996 (Patent Document 1) discloses an image forming apparatus. The apparatus shows a warning for prompting a replacement of an expendable supply on its display, if an activation of a power supply of the apparatus (the apparatus is powered on) or a cancellation of its energy-saving mode (the apparatus is resumed from its energy-saving mode) is detected after it is detected that the expendable supply is almost expired and before it is detected that the expendable supply had been expired.

SUMMARY OF THE INVENTION

In the apparatus disclosed in the Patent Document 1, as described above, a warning for prompting a replacement of an expendable supply on its display, if an activation of a power supply of the apparatus or a cancellation of its energy-saving mode is detected after it is detected that the expendable supply is almost expired and before it is detected that the expendable supply had been expired. Therefore, the warning has to be displayed every time of activations of the power supply or cancellations from the energy-saving mode.

Printing can be done without immediate replacement of the expendable supply after it is detected that the expendable supply is almost expired and before it is detected that the expendable supply had been expired. Therefore, urgency for displaying the warning during this period is less than that after this period (i.e. after the expendable supply had been expired). If the warnings for prompting a replacement of the expendable supply are displayed every time of activations of the power supply or cancellations from the energy-saving mode during the above period, a user feels bothersome.

An object of the present invention is to provide a printer that can provide a warning that an expendable supply is almost expired to a user at a timing when the user doesn't feel bothersome, and to provide an expendable supply for a printer that can provide a warning that the expendable supply is almost expired to a user at a timing when the user doesn't feel bothersome A first aspect of the present invention provides a printer including a main unit that carries out a printing operation and an expendable supply that is replaceably installed in the main unit and is used at the printing operation, the printer comprising: a detector that detects at least one of a power-on operation of the printer, a resume from an energy-saving mode of the printer and a new installation of an expandable supply in the main unit; a determiner that determines whether or not a recommended limit of the expendable supply has passed, based on a production date or a usage start date of the expendable supply, the recommended limit set before a usable limit of the expendable supply, and an elapsed date from the production date or the usage start date; a warning generator that generates a warning for notifying that the usable limit will come soon, when it is determined by the determiner that the recommended limit has already passed; and a memory storage that stores a warning cycle that is an interval between two warning generations, and a timing of a last warning generation after the recommended limit, wherein, when it is determined by the determiner that the recommended limit has passed and the power-on operation, the resume from the energy-saving mode or the new installation is detected by the detector, the warning generator generates a warning [1] when the timing of the last warning generation is not yet stored in the memory storage, or [2] when the timing of the last warning generation is already stored in the memory storage and the warning cycle has elapsed from the last warning generation.

It is preferable that the memory storage stores the warning cycle that is provided as an integral multiple of a first preset period, and a second preset period that is set shorter than the first preset period, and, when it is determined by the determiner that the recommended limit has passed and the power-on operation, the resume from the energy-saving mode or the new installation is detected by the detector, the warning generator generates a warning [1] when the timing of the last warning generation is not yet stored in the memory storage, or [2] when the timing of the last warning generation is already stored in the memory storage, the warning cycle has elapsed from the last warning generation and the second preset period has elapsed in the first preset period at a current timing.

It is preferable that the warning cycle is set according to an elapsed period from the recommended limit so that the closer to the usable limit, the shorter the warning cycle is made.

It is preferable that the warning cycle is set so that the larger a usable remaining amount of the expendable supply is, the shorter the warning cycle is made.

It is preferable that the memory storage further stores a location table in which local codes that indicate locations and normally-usable periods of the expendable supply are associated with each other, a normally-usable period is a period from the production date or the usage start date to the recommended limit, and the determiner retrieves the normally-usable period that is associated with a local code from the location table, and determines whether or not the recommended limit has passed based on the normally-usable period and the production date or the usage start date.

A second aspect of the present invention provides an expendable supply replaceably installed in a main unit of a printer that includes the main unit that carries out a printing operation, and used at the printing operation, wherein the printer comprises a detector that detects at least one of a power-on operation of the printer, a resume from an energy-saving mode of the printer and a new installation of an expandable supply in the main unit, a determiner that determines whether or not a recommended limit of the expendable supply has passed, based on a production date or a usage start date of the expendable supply, the recommended limit set before a usable limit of the expendable supply, and an elapsed date from the production date or the usage start date, a warning generator that generates a warning for notifying that the usable limit will come soon, when it is determined by the determiner that the recommended limit has already passed, and a memory storage that stores a warning cycle that is an interval between two warning generations, the expendable supply comprising: a memory that stores a timing of a last warning generation after the recommended limit, wherein, when it is determined by the determiner that the recommended limit has passed and the power-on operation, the resume from the energy-saving mode or the new installation is detected by the detector, the warning generator generates a warning [1] when the timing of the last warning generation is not yet stored in the memory, or [2] when the timing of the last warning generation is already stored in the memory and the warning cycle has elapsed from the last warning generation.

It is preferable that the memory of the expendable supply stores the warning cycle that is provided as an integral multiple of a first preset period, and the memory storage of the main unit stores a second preset period that is set shorter than the first preset period, and, when it is determined by the determiner that the recommended limit has passed and the power-on operation, the resume from the energy-saving mode or the new installation is detected by the detector, the warning generator generates a warning [1] when the date of the last warning generation is not yet stored in the memory, or [2] when the date of the last warning generation is already stored in the memory, the warning cycle has elapsed from the last warning generation and the second preset period has elapsed in the first preset period at a current timing.

DESCRIPTION OF THE EMBODIMENT

In the present embodiment, an inkjet printer 1 (see FIG. 1) includes a main unit 2 (see FIG. 2), and ink cartridges (expendable supplies) 150 that are installed in the main unit 2 and are prepared by colors. Inks are supplied to the ink cartridges 150 installed in the main unit 2, and then the inks are ejected onto a print sheet (paper) to form images, texts or the like on the print sheet.

<Configurations of Inkjet Printer>

Figure 1:
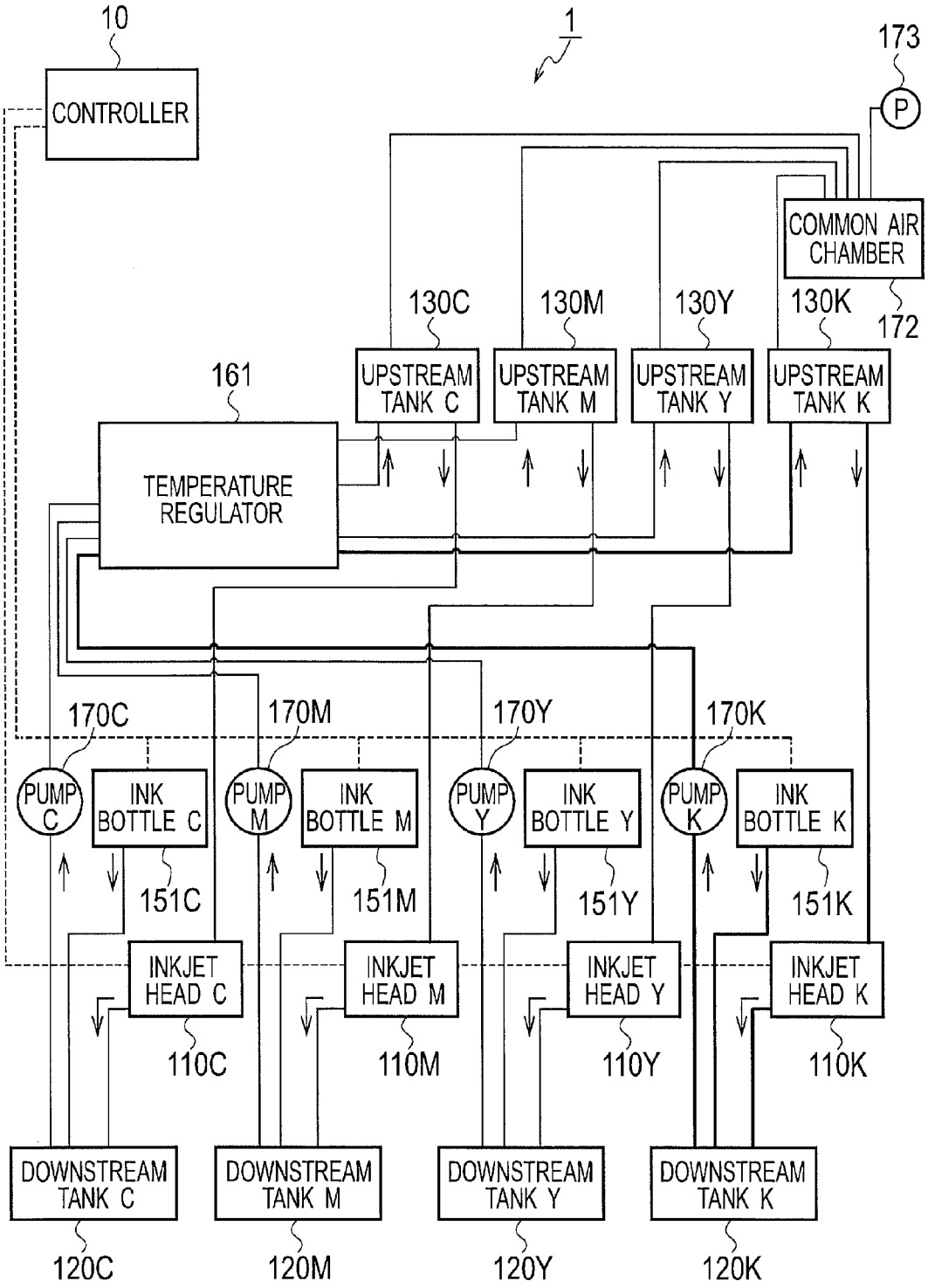
FIG. 1 is a block diagram of an inkjet printer according to an embodiment.
Figure 2:
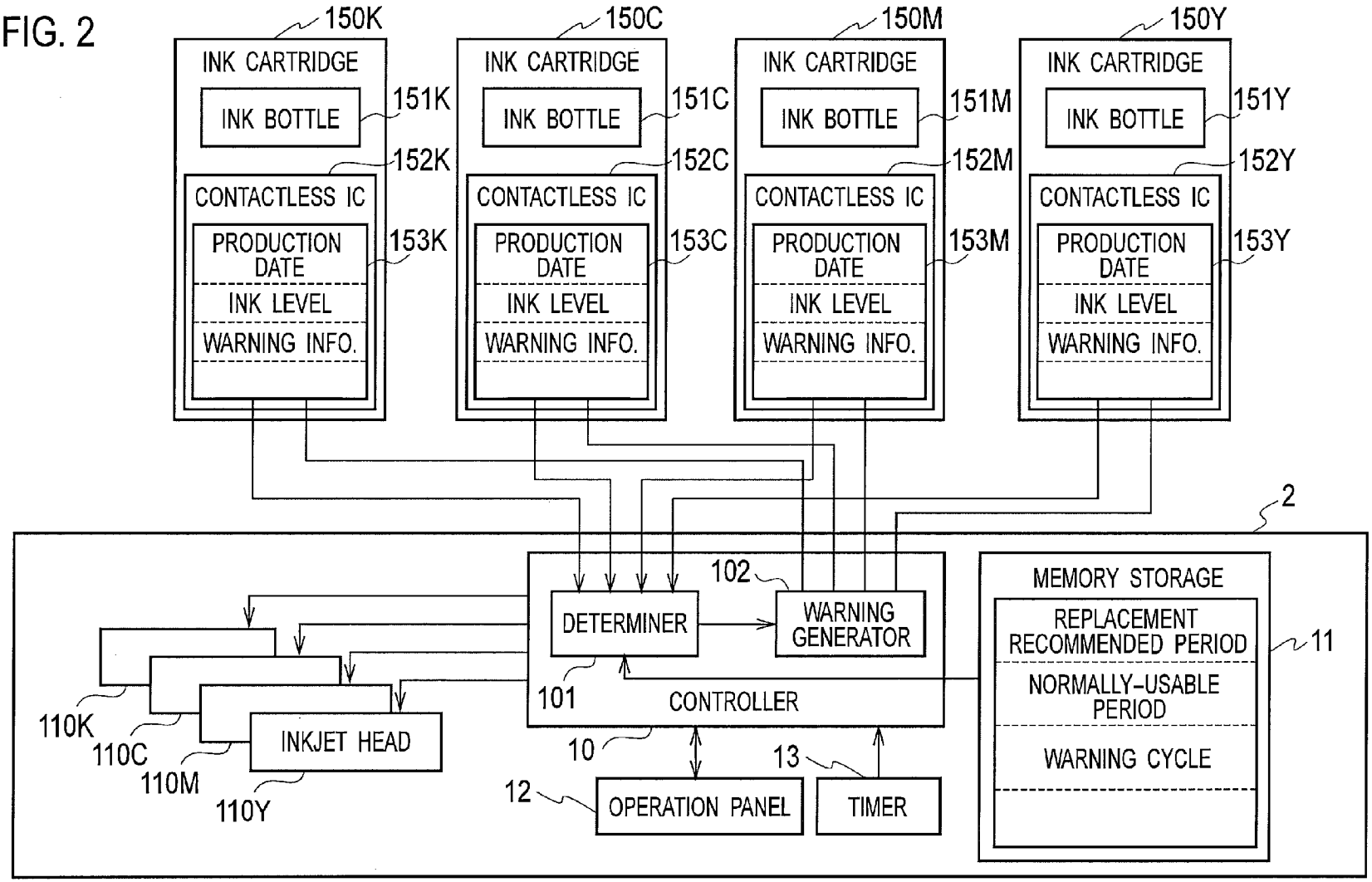
FIG. 2 is another block diagram of the inkjet printer.

As shown in FIG. 1 and FIG. 2, the inkjet printer 1 according to the present embodiment includes ink cartridges 150 (150C, 150M, 150Y and 150K, see FIG. 2), and a main unit 2 comprised of components other than the ink cartridges 150. FIG. 1 shows the inkjet printer 1 in which the ink cartridges 150 are already installed.

The inkjet printer 1 includes inkjet heads 110 (110C, 110M, 110Y and 110K) that are corresponding to C (cyan) M (magenta) Y (yellow) and K (black) color inks. A print sheet(s) is fed by an endless feed belt (not shown in the drawings) provided so that its feed surface faces the inkjet heads 110 at a feed speed determined according to a print setting, and images, texts or the like are printed on the print sheet by the inks ejected from the inkjet heads 110 line by line while the print sheet is fed.

Each of the ink cartridge 150 is configured so as to be installable in the main unit 2 and removal from the main unit 2, and includes an ink bottle 151 and a contactless IC 152 that stores various information concerning ink contained therein.

Each ink is supplied from its corresponding ink bottle 151, and an ink bottle 151C for supplying cyan ink, an ink bottle 151M for supplying magenta ink, an ink bottle 151Y for supplying yellow ink and an ink bottle 151K for supplying black ink are provided. Note that the ink bottles are described only with their representative reference number 151 without their color suffix CMYK, if they are not needed to be explained by color. This rule is also applied to other components.

Ink is supplied from the ink bottle 151, through an ink circulation path formed by a pipe made of resign, metal or the like, to a downstream tank 120 provided on a downstream side of the inkjet head 110, and then temporarily held in the downstream tank 120. Therefore, a downstream tank 120C for accumulating cyan ink, a downstream tank 120M for accumulating magenta ink, a downstream tank 120Y for accumulating yellow ink and a downstream tank 120K for accumulating black ink are provided in the inkjet printer 1.

The inkjet printer 1 also includes pumps 170 (170C, 170M, 170Y and 170K) and upstream tanks 130 (130C, 130M, 130Y and 130K). The ink accumulated in the downstream tank 120 is supplied to the upstream tank 130 provided on an upstream side of the inkjet head 110. The ink supplied to the upstream tank 130 is further supplied to the inkjet head 110 on which many nozzles for ejecting the ink are provided.

The upstream tanks 130 are connected with a common air chamber 172. The common air chamber 172 is provided with a pump 173 and a pressure relief valve (not shown in the drawings). Air pressure in the upstream tanks 130 is regulated by sending air into the upstream tanks 130 by use of the pump 173 with the pressure relief valve fully closed, or by fully opening the pressure relief valve so as to regulate the air pressure at atmospheric pressure.

Ink that was not ejected from the inkjet head 110 is returned to the downstream tank 120. Ink circulation from the upstream tank 130 to the downstream tank 120 through the inkjet head 110 is done by hydraulic head difference between the upstream tank 130 and the downstream tank 120.

An temperature range is regulated for ink, and print quality is assured within the temperature range. When environment temperature is low and thereby ink temperature is lower than printable lower limit temperature, ink is needed to be warmed. On the other hand, ink temperature may rise due to heat generated by operations of a driver or a piezoelectric element provided in the inkjet head 110 and Joule heat generated by ink vibration. It is needed to restrict affection of the ink temperature rise due to the above-described heats. Therefore, a temperature regulator 160 is provided on ink circulation paths, and thereby ink is cooled or warmed by the temperature regulator 160.

In addition, the inkjet printer 1 is also includes a controller 10 for controlling the main unit 2. The controller 10 detects replacement of the ink cartridges 150 in the main unit 2. Namely, the controller 10 detects a new installation of an ink cartridge 150 into the main unit 2 (an installation of a new ink cartridge 150 into the main unit 2). Specifically, the controller 10 detects that the ink cartridges 150 is already installed or that a new ink cartridge 150 has just installed through a change of installation status of the ink cartridge(s) 150 in the main unit 2. The installation status is detected by the controller 10 and a cartridge sensor (not shown).

The controller 10 is provided in the main unit 2, and has a communication function for transferring data wirelessly with the ink cartridges 150 installed in the main unit 2. Further, the controller 10 detects a power-on operation of the inkjet printer 1 and a resume from an energy-saving mode of the inkjet printer 1. Namely, the controller 10 serves as a detector that detects a power-on operation of the inkjet printer 1 and a resume from an energy-saving mode of the inkjet printer 1. Here, the energy-saving mode is a mode in which an after-described warning screen cannot be displayed due to restriction of energy consumption, e.g. a sleep mode for restricting energy consumption. A resume from the energy-saving mode is a transfer of modes from the sleep mode to a normal mode in which printing can be done.

As shown in FIG. 2, the ink cartridge 150 (i.e. each of the ink cartridges 150) includes the ink bottle 151 and the contactless IC 152 (IC chip that communicates with the controller 10 contactlessly/wirelessly). The contactless IC 152 is provided with a memory 153, and exchanges data wirelessly with the controller 10 disposed in the main unit 2.

The memory 153 stores a production date of the ink cartridge 150, an ink level that is an estimated remaining amount of ink accumulated in the ink cartridge 150, and warning information that indicates timing (s) [date and time] when a warning was generated. Note that the ink level can be calculated (estimated) by subtracting an ejected amount from the inkjet head 110 and so on from an initial amount, for example. The warning information has a "null" value as its initial value (is blank at its initial state), and then a timing when a first warning is generated is recorded in it. The warning information is updated when a new warning is generated by overwriting the timing of warning generation.

A memory storage 11 is provided for the controller 10, and stores, with respect to each of the ink cartridges 150, a normally-usable period during which the ink cartridge 150 is normally usable (without any problems), and a replacement recommended period during which the ink cartridge 150 is usable but a replacement of the ink cartridge 150 is recommended.

Figure 3:
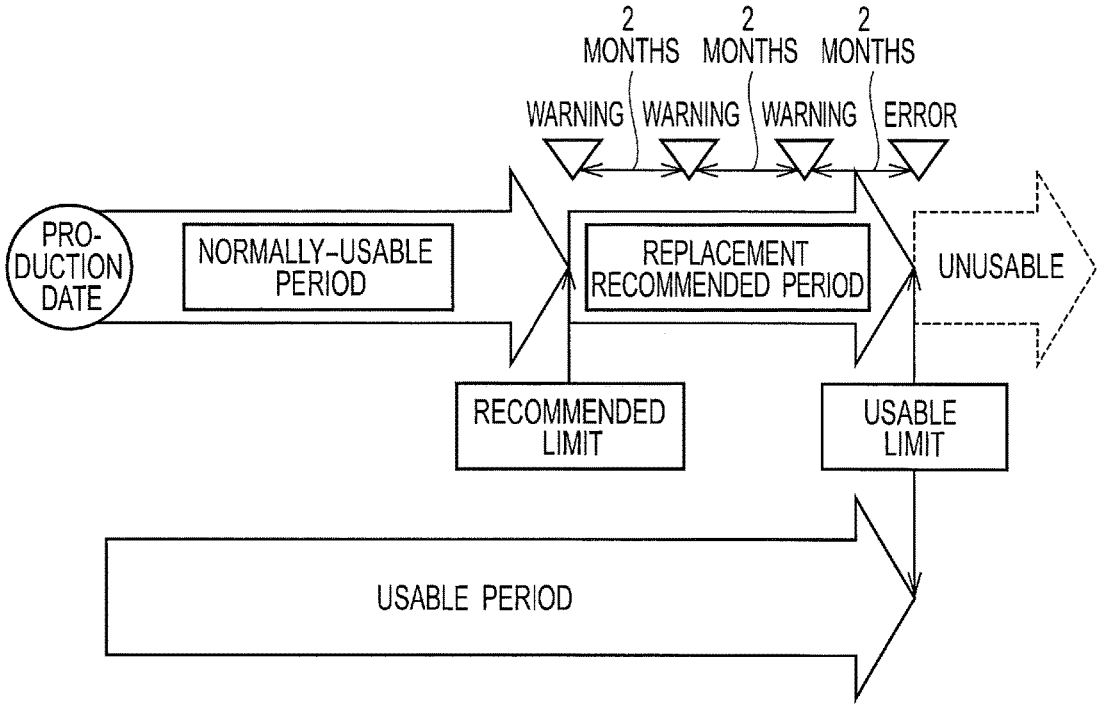
FIG. 3 is a diagram for explaining a usable period and a replacement recommended period.

FIG. 3 shows an example of the normally-usable period and the replacement recommended period stored in the memory storage 11. The normally-usable period is a period from the production d date (or a usage start date [an unpackaged date]) to an after explained recommended limit.

As shown in a Table 1 shown below, with respect to the normally-usable period, a settable range (month), a set unit for the settable range, and a default value that will be used as the normally-usable period when the normally-usable period is not set are associated with each other, and stored in the memory storage 11 with respect to each ink color.

TABLE 1

| | Ink | Settable Range (month) | Set Unit | Default Value |
|---|---|---|---|---|
| Normally-usable Period | black (K) | 1 to 60 | 1 | 2 |
| | cyan (C) | 1 to 60 | 1 | 2 |
| | . | | | |
| | . | | | |
| | . | | | |
| Replacement Recommended period | black (K) | 0 to 20 | 1 | 3 |
| | cyan (C) | 0 to 20 | 1 | 3 |
| | . | | | |

TABLE 1-continued

| | Ink | Settable Range (month) | Set Unit | Default Value |
|---|---|---|---|---|
| | . | | | |
| | . | | | |

Similarly, with respect to the replacement recommended period, a settable range (month), a set unit for the settable range, and a default value that will be used as the replacement recommended period when the replacement recommended period is not set are associated with other and stored in the memory storage 11 with respect to each ink color.

In addition, not shown in the drawings, a warning cycle that is an interval between two warning generations is also stored in the memory storage 11. For example, when two months (an integral multiple of a month) are set as the warning cycle, a warning will be generated every two months. The warning generations every two months will be described in detail later.

As shown in FIG. 3, the recommended limit is a limit date when the above-described normally-usable period elapses from the above-described production date (or the usage start date). After the recommended limit is passed, a usable limit will become soon and thereby the above-described replacement recommended period is set in order to prompt a replacement of the ink cartridge 150. In the replacement recommended period, warnings will be generated per the warning cycle (every 2 months in the present embodiment). A usable limit is a limit date when the replacement recommended period elapses from the recommended limit. The ink cartridge 150 may become unprintable (unusable) after the usable limit, so that an error is generated. A usable period during which the ink cartridge 150 is usable (period during which the inkjet printer 1 is normally usable [normally-usable period]+period during which a replacement is recommended but the inkjet printer 1 is usable [replacement recommended period]) is a period from the production date to the usable limit.

As shown in FIG. 2, an operation panel 12 is connected to the controller 10, and, for example, is configured of an operational screen and a touchscreen. The operation panel 12 is disposed at an upper portion of the inkjet printer 1. The operation panel 12 is used as an input device, so that a user can input a duplicating print command (i.e. copy command) for a printed image set on a scanner unit (not shown in the drawings) of the inkjet printer 1, and can input a print setting such as the number of copies to print and processing contents (e.g. print scaling, simplex/duplex printing and so on).

In addition, the recommended limit, the warning cycle and so on can be input through the operation panel by a user. The controller 10 applies the above operations input through the operation panel 12 to the contents stored in the memory storage 11.

A timer 13 is also connected to the controller 10. The timer 13 retrieves the production date from the contactless IC 152 of the ink cartridge(s) 150 via the controller 10, and then measures an elapsed date (time) from the production date.

The controller 10 that controls the inkjet heads 110 to carry out printing is an arithmetic processing unit configured of hardware devices such as processors (e.g. a CPU, a DSP and so on), memories and other electrical components or software having similar functions thereto, or configured by combining them. The controller 10 virtually constructs various functional modules by retrieving programs and then executing them, and thereby executes processings concerning image data, controlling of various components, and various processings in relation to user's operations.

Specifically, the controller 10 configures a determiner 101 and a warning generator 102 as the functional modules. Note that the term "module(s) used in the present embodiment is configured of hardware devices or software having similar functions thereto, or configured by combining them, and indicates a functional unit for achieving a predetermined operation.

The determiner 101 determines (confirms) the production date of the ink cartridge(s) 150 and the recommended limit of the ink cartridge(s) 150, and determines (judges) whether or not the recommended limit has passed based on the elapsed date (time) from the production date.

The warning generator 102 generates a warning for notifying the usable limit will come soon under a predetermined condition, when it is determined by the determiner 101 that the recommended limit has already passed. The predetermined condition will be described later.

Figure 4:
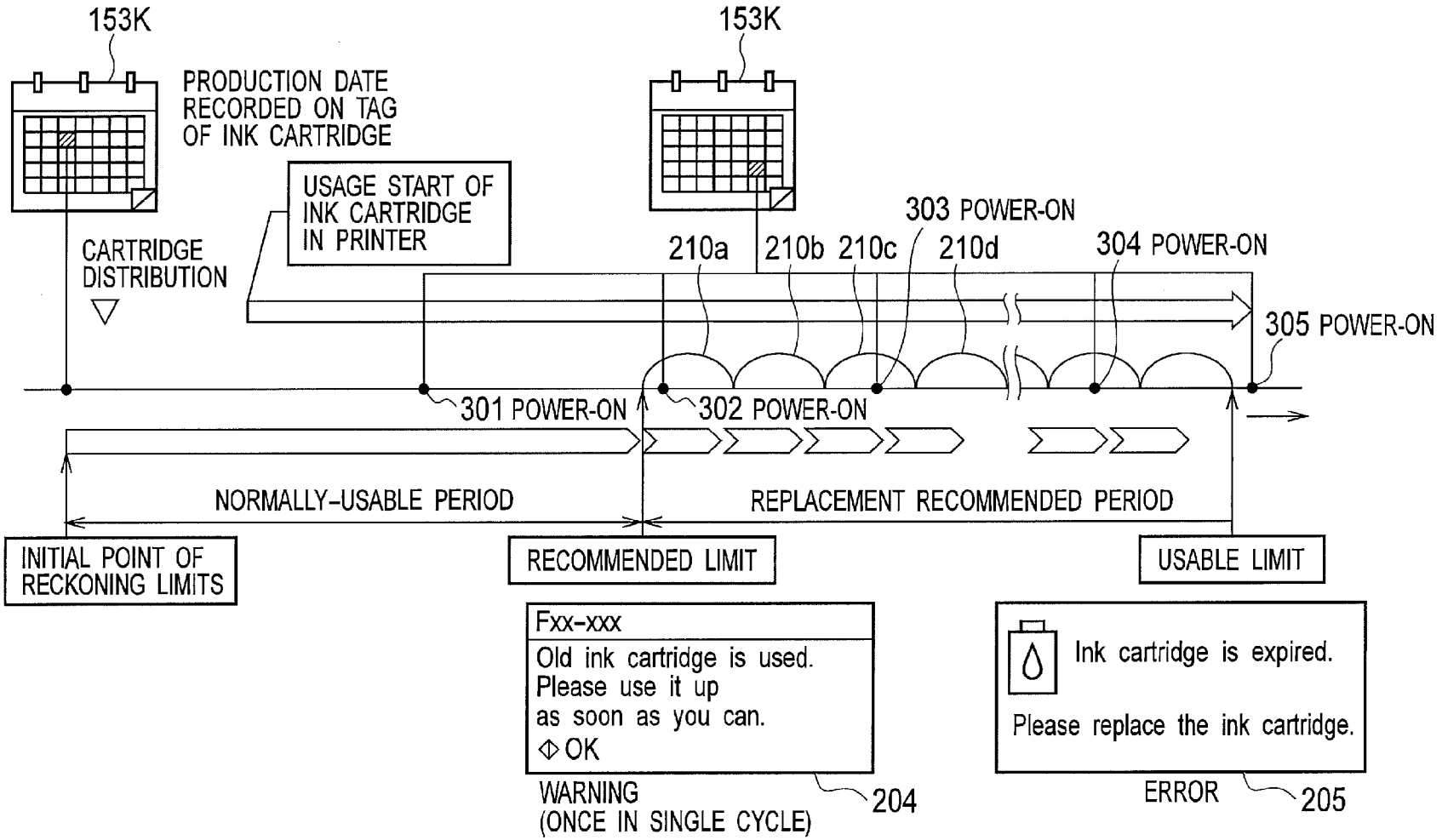
FIG. 4 is a time chart showing operations of a determiner and a warning generator of the inkjet printer.

As shown in FIG. 4, in the present embodiment, the production date stored in the memory 153 of the ink cartridge 150 is an initial point for reckoning the limits (the recommended limit and the usable limit) A time point when the normally-usable period elapses from the production date is the recommended limit. A period from the recommended limit to the usable limit is the replacement recommended period.

The determiner 101 determines whether or not the recommended limit of the ink cartridge has passed based on the production date stored in the memory 153 of the ink cartridge 150, the recommended limit estimated on the basis of the replacement recommended period of the ink cartridge 150, and the elapsed date (time) from the production date that is measured by the timer 13.

Subsequently, when it is determined by the determiner 101 that the recommended limit has already passed and the inkjet printer 1 is powered on or the inkjet printer 1 is resumed from its energy-saving mode, the warning generator 102 displays, on the operation panel 12, a warning message (a message window, a message screen) notifying that the usable limit of the ink cartridge 150 will come soon under the predetermined condition. Note that, if no warning information is stored in the memory 153 of the ink cartridge 150, the warning generator 102 displays the warning message on the operation panel 12, and newly generated warning information is stored in the memory 153 concurrently. Namely, the above-described message as a warning is displayed (1) when the recommended limit has passed and no warning information is stored in the memory 153, or (2) when the warning information already exists in the memory 153 and a single warning cycle has elapsed from the last warning generation. These (1) and (2) are the above-mentioned predetermined condition.

For example, an operation of a power-on 301 shown in FIG. 4 is made during the normally-usable period and the recommended limit has not passed, so that the warning generator 102 doesn't display the warning (the above-described message) on the operation panel 12.

An operation of a power-on 302 is made during the replacement recommended period and the recommended limit has passed. In addition, no warning information is stored in the memory 153, if no warning is generated before the power-on 302. In this case, the warning generator 102 displays the warning (the above-described message) on the operation panel 12. Specifically, a warning message 204 "Old ink cartridge is used. Please use it up as soon as you can." shown in FIG. 4 is displayed on the operation panel 12 by the warning generator 102.

Then, an operation of a power-on 303 is made during the replacement recommended period and the recommended limit has passed. In addition, the warning information has been stored in the memory 153 when the operation of the power-on 302 was made. If the warning cycle is set to two months, the power-on 302 is made on a month 210*a* and the power-on 303 is made on a month 210*c* after a single warning cycle (=two months) has elapsed from the power-on 302, so that the warning generator 102 displays the warning (the above-described message) on the operation panel 12 when the operation of the power-on 303 is made.

Further, the ink cartridge 150 may become unprintable (unusable) after the usable limit, so that the warning generator 102 generates an error in this case. An operation of a power-on 305 is made after the usable limit has already passed, so that the warning generator 102 displays, on the operation panel 12, a message notifying that the usable limit of the ink cartridge 150 has passed as an error. Specifically, an error message 205 "Ink cartridge is expired. Please replace the ink cartridge." shown in FIG. 4 is displayed on the operation panel 12 by the warning generator 102.

Figure 5:
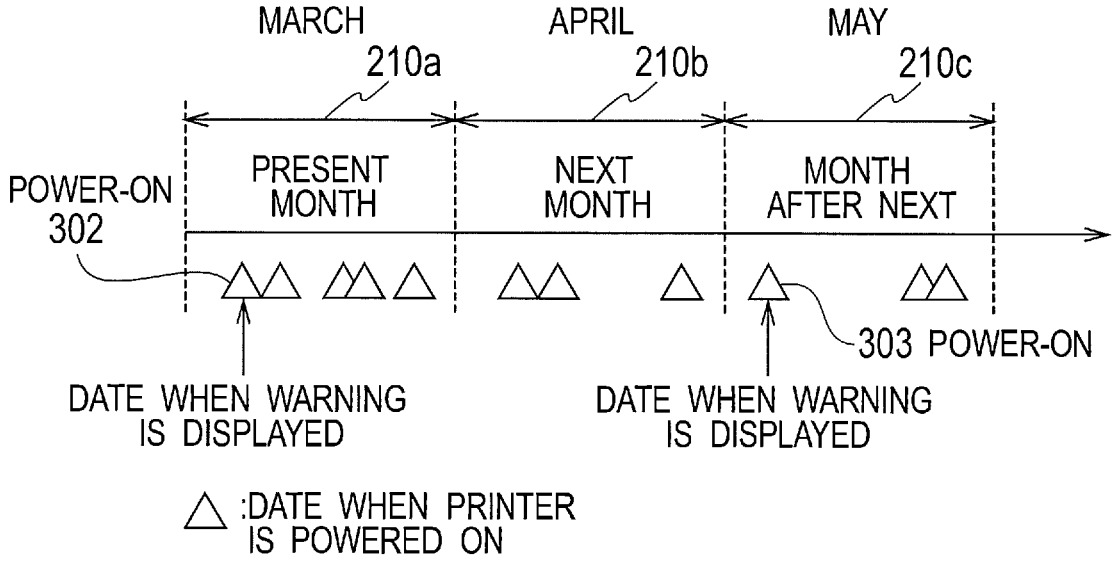
FIG. 5 is a time chart showing operations of the warning generator of the inkjet printer.

The warning generator 102 will be described further with reference to FIG. 5. For convenience of description, the month 210*a* is March, a month 210*b* is April, and the month 210*c* is May in FIG. 5. When the operation of the power-on 302 is made on March, the warning generator 102 displays the warning message 204 on the operation panel 12 to notify that the usable limit of the ink cartridge 150 will come soon.

After the first warning generation (i.e. the power-on 302), even when an operation of a power-on (indicated by white triangles) is made, no warning is generated until two months elapses from the last warning generation. In the example shown in FIG. 5, the condition "two months elapses from the last warning generation" means that month number increases by two. In this case, month number increases from 3 (March) to 5 (May) when the operation of the power-on 303 is made after the operation of the power-on 302 was made. Therefore, a warning is generated at the operation of the power-on 303. On the other hand, no warning is generated at operations of power-on in March other than the power-on 302, and at all operations of power-on in April.

<Operations of Inkjet Printer>

Figure 6:
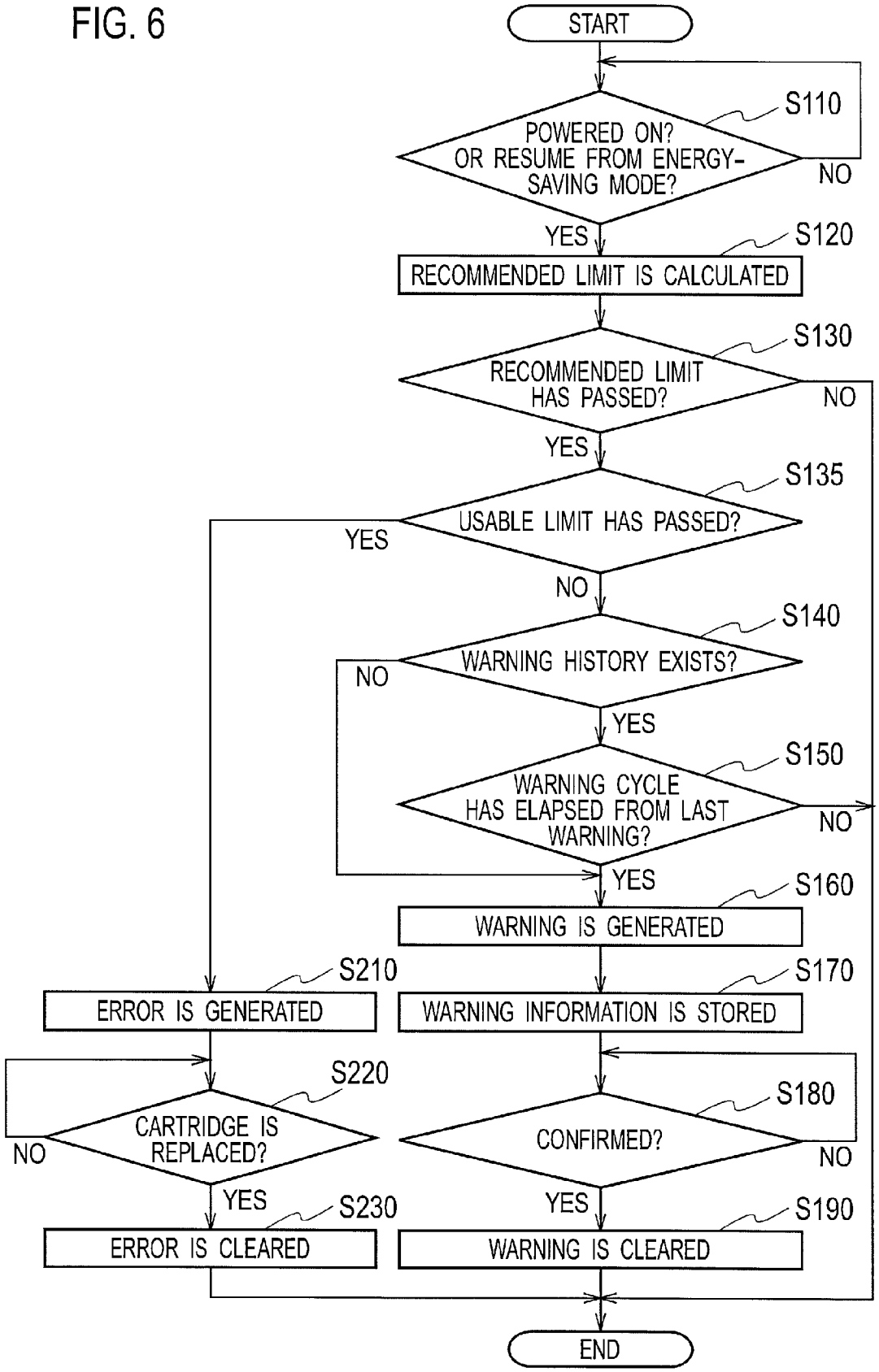
FIG. 6 is a flowchart for describing operations of the inkjet printer.

Operations of the inkjet printer 1 according to the present embodiment will be described with reference to a flowchart shown in FIG. 6.

When a power-on switch is pressed or a resume from the energy-saving mode is detected (YES in step S110), the inkjet printer 1 starts to communicate wirelessly with the contactless IC 152 of the ink cartridge(s) 150 to retrieve the production date stored in the memory 153. Then, the determiner 101 calculates the recommended limit of the ink cartridge 150 based on the production dare retrieved by the wireless communication and the replacement recommended period of the ink cartridge 150 stored in the memory storage 11 (step S120).

Subsequently, based on the production date stored in the memory 153 of the ink cartridge 150, the recommended limit of the ink cartridge 150, and the elapsed date (time) from the production date measured by the timer, the determiner 101 determines whether or not the recommended limit has passed (step S130). When it is determined that the recommended limit has not yet passed (NO in step S130), it means that it is during the normally-usable period and thereby the process flow is ended with no warning generation.

On the other hand, when it is determined that the recommended limit has already passed (YES in step S130), the determiner 101 further determines whether or not the usable limit has passed (step S135). When it is determined that the usable limit has not yet passed (NO in step S135), the determiner 101 further determines whether or not the warning history is stored in the memory 153 of the ink cartridge 150 by use of the wireless communication (step S140).

As described above, the initial value of the warning information is "null (blank)", and the timing of the first warning generation is stored as the warning information when the first warning is generated. Therefore, in a case where the warning information is already stored in the memory 153, at least one warning has been generated before. On the other hand, in a case where no warning information is stored in the memory 153 (i.e. null), no warning has been generated before.

When it is determined that the warning history is already stored in the memory 153 (YES in step S140), it means that at least one warning has been generated before and thereby the determiner 101 determined, based on the warning history (the warning information stored in the memory 153, i.e. the timing of the last warning generation), whether or not the single warning cycle has passed from the last warning generation (step S150). For example, if the warning cycle is set to two months, it is determined whether or not two months has passed from the last warning generation.

When it is determined that the single warning cycle has not yet passed from the last warning generation (NO in step S150), the process flow is ended with no warning generation in order to prevent a user from feeling bothersome. On the other hand, when it is determined that the single warning cycle has already passed from the last warning generation (YES in step S150), the warning generator 102 displays the warning message 204 on the operation panel 12 (step S160), because it can be assumed that a period in which a new warning is redundant and may give a bothersome feeling to a user has already elapsed.

Subsequently, the warning generator 102 stores the new warning information in the memory 153 of the ink cartridge 150 (step S170). Specifically, in a case where no warning information is stored in the memory 153 (i.e. null), the timing of the first warning generation is stored in the memory 153 as the warning information (the warning history). In another case where the warning information is already stored in the memory 153, the warning information (the warning history) is updated by storing the timing of the new warning generation over the already-stored warning information.

Then, when an OK button in the warning message 204 (see FIG. 4) displayed on the operation panel 12 is touched (pressed) by a user (the warning is confirmed by the user: YES in step S180), the warning message 204 is cleared from the operation panel 12 (step S190) and thereby the process flow is ended.

On the other hand, when it is determined that the usable limit has already passed (YES in step S135), the warning generator 102 displays the error message 205 on the operation panel 12 (step S210) to notify that the usable limit of the ink cartridge 150 has already passed.

Then, when it is detected that the ink cartridge 150 is replaced by a new one (YES in step S220), the error message 205 is cleared from the operation panel 12 (step S230) and thereby the process flow is ended. Namely, the inkjet printer 1 cannot be used until the ink cartridge 150 is replaced by a new one in the step S220.

Therefore, according to the inkjet printer 1 in the present embodiment, the determiner 101 determines whether or not the recommended limit has passed based on the production date stored in the memory 153, the recommended limit calculated from the replacement recommended period stored in the memory storage 11 and so on, and the elapsed date (time) measured by the timer 13. When it is determined by the determiner 101 that the recommended limit has already passed and a power-on of the inkjet printer 1 or a resume from the energy-saving mode is detected, a warning is generated if the following condition (1) or (2) is satisfied. (1) No warning information is stored in the memory 153. (2) The warning information already exists in the memory 153, and a single warning cycle has elapsed from the last warning generation. Therefore, the warning is not generated at every power-on of the inkjet printer 1 (and at every resume from the energy-saving mode) after the recommended limit, so that it can be notified timely to a user that the usable limit of the ink cartridge 150 will come soon and user's bothersome feeling to the warning generations can be reduced.

In the inkjet printer according to the present embodiment, the memory 153 is disposed in each of the ink cartridges 150 to store the production date, the ink level and the warning information, and the memory storage 11 is disposed in the main unit 2 to store the warning cycle, the normally-usable period (for each of the ink cartridges 150) and the replacement recommended period (for each of the ink cartridges 150). Therefore, these configurations are not limited to the above configurations in the present embodiment. All of the production date, the warning information, the normally-usable period, the replacement recommended period and the warning cycle may be stored in the memory storage 11 or in the memory 153. Each of the above data parameters may be stored in the memory storage 11 or in the memory 153. It is possible to select stored locations (the memory storage 11 or the memory 153) of the data parameters arbitrarily until the inkjet printer 1 is shipped out to the market.

In the present embodiment, the warning generator 102 displays the warning message 204 on the operation panel 12 when the determiner 101 determines, based on the warning information stored in the memory 153 and the warning cycle stored in the memory storage 11, that (b) the recommended limit has already passed, (c1) the inkjet printer 1 is powered on (or (c2) resumed from its energy-saving mode) and (a1) the warning cycle has elapsed from the last warning generation (or (a1) at the first warning generation after the recommended limit). However, the warning may be notified to a used by sounds through a speaker provided in the inkjet printer 1.

In the present embodiment, the recommended limit is a date when the normally-usable period elapses from the above-described production date, and the usable limit is a date when the replacement recommended period elapses from the recommended limit. However, the replacement recommended period may be a period predetermined times (e.g. five times) as long as the warning cycle, and then the usable limit may be set to a date when this replacement recommended period elapses from the recommended limit. In addition, the usable limit may be changed by a user according to a usage environment and a usage condition of the ink cartridge 150. Further, the usable limit may be determined by adding a quality assurance period to the production date. Furthermore, the usable limit may be determined as a quality assurance limit of ink in the ink cartridge 150 based on the production date, and then the recommended limit may be determined by subtracting the replacement recommended period from the usable limit.

Note that the ink cartridge(s) 150 that is installed in the inkjet printer 1 will bring the above-described effects even if it will be installed another inkjet printer. Specifically, the other inkjet printer can determine whether or not the recommended period has passed based on the production date and the warning information stored in the memory 153 of the ink cartridge 150 that was removed from the inkjet printer 1 and then installed in the other inkjet printer, and can determine whether or not the warning cycle has elapsed from the last warning generation based on the production date and the warning information stored in the memory 153 of the ink cartridge 150 that was removed from the inkjet printer 1 and then installed in the other inkjet printer. In this case, if the warning cycle stored in the memory storage of the main unit of the other inkjet printer is different from that of the inkjet printer 1, the warning is generated based on the warning cycle of the main unit of the other inkjet printer.

Modified Example 1

A modified example 1 will be described with reference to FIG. 7. In the above embodiment, the new warning is generated at the first power-on (or the first resume from the energy-saving mode) after the warning cycle has elapsed from the last warning generation. In the present modified example, a date when a warning is to be generated is stored as a warning generation date. Then, a warning is generated when the warning generation date has elapsed in a month. Note that the present modified example is applied to the second or later warning generation. Therefore, the present modified example is not applied to the first warning generation, because the first warning is usually generated too long before the usable limit and thereby an order placement of the ink cartridge 150 for its restock seems to be less needed.

The memory storage 11 stores the warning cycle that is set to an integral multiple of a first preset period (i.e. a "month" in the present embodiment), and a second preset period (i.e. the warning generation date) that is set shorter than the first preset period. Namely, the warning cycle that is set to an integral multiple of a month (one month or plural months).

When the determiner 101 determines that the recommended limit has passed and a power-on operation of the inkjet printer 1 (or a resume from the energy-saving mode) is detected, the warning generator 102 generates the warning (1) when no warning information is stored in the memory 153, or (2) when the warning information already exists in the memory 153 and the second preset period has elapsed (i.e. after the above-explained warning generation date) in the first preset period associated with a current timing. Note that the second preset period indicates a period from one time point to another time point. Here, the other time point can be made illimitably closer to the one time point, so that the second preset period can take not only a period but also a time point (timing).

Figure 7:
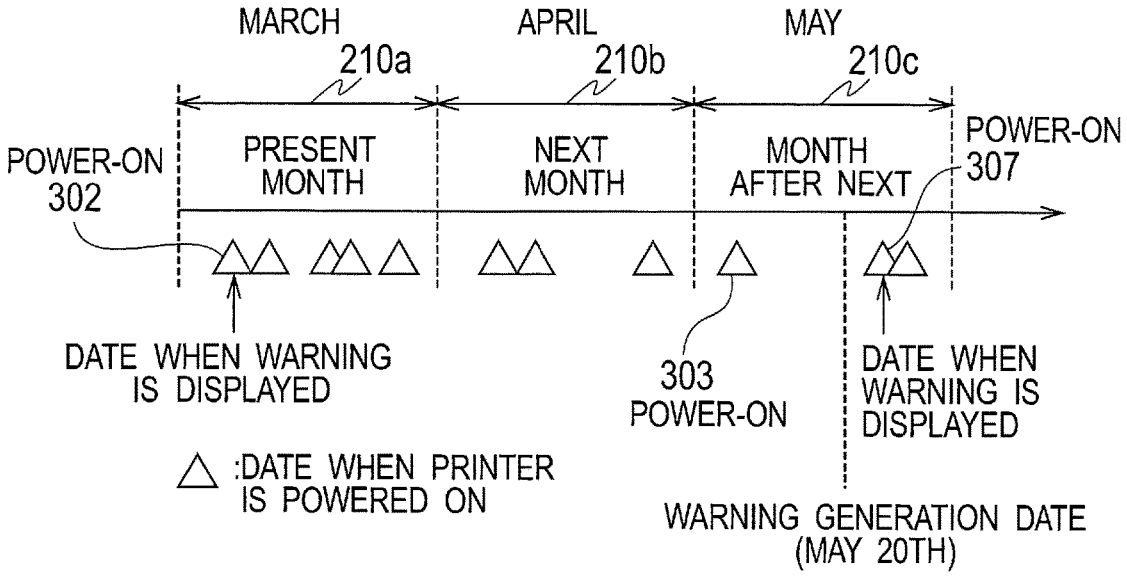
FIG. 7 is a time chart showing operations of a warning generator of an inkjet printer according to a modified example.

As shown in FIG. 7, the month 210*a* is March, a month 210*b* is April, and the month 210*c* is May for convenience of description. In the memory storage 11, the warning cycle is set to two months (an integral multiple of the first preset period), and the warning generation date is set to twentieth (date: or twenty days) as the second preset period.

When the operation of the power-on 302 is made on March, the warning generator 102 displays the warning message 204 on the operation panel 12 to notify that the usable limit of the ink cartridge 150 will come soon. After the first warning generation (i.e. the power-on 302), even when an operation of a power-on (indicated by white triangles) is made, no warning is generated until two months elapses from the last warning generation. Therefore, no warning is generated at operations of power-on in March other than the power-on 302, and at all operations of power-on in April.

Then, the next warning is generated at an operation of power-on 307 when two months (the warning cycle, an integral multiple of the first preset period) elapses from the last warning generation (i.e. the power-on 302) [i.e. when May starts (May is two months later than March)] and the twentieth (the warning generation date, the second preset period: i.e. May 20th) has also passed. Namely, twenty days has already elapsed in May. Note that no warning is generated at the operation of the power-on 303, because the twentieth (the warning generation date, the second preset period: i.e. May 20th) has not yet passed (twenty days has not yet elapsed).

In the present modified example, an integral multiple of a month (one month or plural months) is stored in the memory storage 11 as the warning cycle (an integral multiple of the first preset period), a period shorter than the warning cycle is also stored in the memory storage 11 as the warning generation date (the second preset period [date], [timing]). The warning generator 102 generates the warning (1) when no warning information is stored in the memory 153, or (2) when the warning information already exists in the memory 153 and the second preset period has elapsed (i.e. after the above-explained warning generation date) in the first preset period associated with a current timing (i.e. the warning generation date has passed in a month whose number is incremented by the number of months indicated by the warning cycle [3 (March) is increased to 5 (May) by 2 (months indicated by the warning cycle)]). Therefore, user's bothersome feeling to the warning generations can be reduced, especially in a case where expendable supplies are checked once every month by using a purchase management system for restocking ink cartridges.

For example, in a case where an order for restocking the ink cartridge(s) 150 is placed on every twenty-fifth in every month according to a stock status of the ink cartridges 150, bothersome feelings may be given to a user(s), if the warning is generated (the warning message 204 is displayed on the operation panel 12) repeatedly at every power-on operation (or every resume from the energy-saving mode) during the first to the twentieth (set as the warning generation date in the present modified example) in a month. This is because an order for restocking the ink cartridge(s) 150 is not placed until the twenty-fifth (purchase order date).

According to the present modified example, the warning is not generated during the first to the twentieth, because the warning generation date (the second preset date) has not yet passed. Then, the warning is generated at the first power-on operation (or the first resume from the energy-saving mode) after the warning generation date (the second preset date: May 20th in the present modified example) has passed. Therefore, the warning generation doesn't give a bothersome feeling to a user(s).

The warning generation date as the second preset period may be set to a monthly purchase order date of the ink cartridge(s) 150, or may be set to a date that is predetermined days after a monthly purchase order date of the ink cartridge(s) 150. Alternatively, the second preset period (the warning generation date) may be set as a few days before and after a monthly purchase order date, or may be set as one week before and after a monthly purchase order date (i.e. the second preset period is two weeks in this case).

The warning generation date as the second preset period may be changed based on the warning history so that the warning will be generated during a few days before and after a monthly purchase order date according to the purchase order date (that may be set arbitrarily in a month). For example, timings [dates] of the past warning generations are stored as the warning history, and, in a case where the past warning generations were often made during the thirteenth to the fifteenth and the monthly purchase order date is eighteenth, the warning generation date (the second preset period) can be set to a period from the fifteenth to the eighteenth. This is because it is convenient for a user(s) that the warning generation date (the second preset period) for displaying the warning message 204 is set be set as a few days (the fifteenth to the eighteenth) before the monthly purchase order date (the eighteenth). In this case, the warning generation date (the second preset period) may be set automatically, or may be set based on a user's operation.

The warning message 204 (the generated warning) may contains an additional content that notifies a need for placing an order of the ink cartridge(s) 150.

In the present modified example, the first preset period is a month, and the second preset period is set as a date (days, timing) that is shorter than a month. These are not limited to those in the present modified example. The first preset period may be a month, and the second preset period may be an integral multiple of a week (one week or plural weeks). For example, when two weeks are set as the second preset period, the warning will be generated after the second week has elapsed in the month corresponding to the first preset period.

In the above modified example, the second preset period is determined based on the monthly purchase order date. However, the second preset period may be determined based on a date or the like that is associated with the management of the expendable supplies other than the monthly purchase order date.

Modified Example 2

A modified example 2 will be described hereinafter. In the above embodiment, the warning is generated at the first power-on operation of the inkjet printer (or the first resume from the power-saving mode) after the preset warning cycle has elapsed. In the present modified example, the warning cycle is set according to an elapsed period from the recommended limit so that the closer to the usable limit of the ink cartridge 150, the shorter the warning cycle is made.

The usable period is set as a quality assurance period of the ink cartridge 150. When the usable limit that is a deadline of the usable period has passed, the ink cartridge 150 may become unusable even if ink remains in it. Therefore, if the ink level is high (the remaining amount of ink is large) despite being closer to the usable limit, it is preferable to increase frequency of the warnings and to display a message for prompting to use up the ink cartridge 150 as soon as possible.

In the present modified example, the warning cycle stored in the memory storage 11 is set so that the closer to the usable limit of the ink cartridge 150, the shorter the warning cycle is made. For example, (i) the warning cycle is set to two months, when four or more months remain to the usable limit of the ink cartridge 150, (ii) the warning cycle is set to one month, when two or more months but less than four months remain to the usable limit of the ink cartridge 150, and (iii) the warning cycle is set to half a month, when less than two months remain to the usable limit of the ink cartridge 150.

In addition, various warning messages are stored in the memory storage 11 according to the remaining periods to the usable limit of the ink cartridge 150. For example, a warning message "Please use it up as soon as you can." is stored for the above case (i). A warning message "Closer to validity date of ink cartridge. Please use it up as soon as you can." is stored for the above case (ii). A warning message "Almost validity date of ink cartridge. Please use it up promptly" is stored for the above case (iii).

According to the present modified example, a user can be prompted to use ink when being closer to the usable limit of the ink cartridge. Therefore, it is possible to consume ink efficiency by avoiding waste during the usable period.

Modified Example 3

A modified example 3 will be described hereinafter. In the above modified example 2, the closer to the usable limit of the ink cartridge 150, the shorter the warning cycle is made according to an elapsed time from the recommended limit. In the present modified example, the higher the ink level of the ink cartridge 150 is (the larger the usable remaining amount of ink is), the shorter the warning cycle is made.

For example, (i) the warning cycle is set to half a month, when the ink level of the ink cartridge 150 is 30 [%] or more, (ii) the warning cycle is set to one month, when the ink level of the ink cartridge 150 is 20 [%] or more but less than 30 [%], and (iii) the warning cycle is set to two months, when the ink level of the ink cartridge 150 is 10 [%] or more but less than 20 [%].

In addition, the present modified example can be combined with the above modified example 2. Specifically, (I) the warning cycle is set to two months, when four or more months remain to the usable limit of the ink cartridge 150 and the ink level of the ink cartridge 150 is 10 [%] or more but less than 20 [%], (II) the warning cycle is set to one month, when two or more months but less than four months remain to the usable limit of the ink cartridge 150 and the ink level of the ink cartridge 150 is 20 [%] or more but less than 30 [%], and (III) the warning cycle is set to half a month when less than two months remain to the usable limit of the ink cartridge 150 and the ink level of the ink cartridge 150 is 30 [%] or more. Note that, in other cases not mentioned above, the default setting will be applied. Namely, the warning cycle is set to two month.

The warning cycle is not limited to the above, and may be set by appropriately combining the ink level with the remaining period to the usable limit. Namely, it is preferable that the higher the ink level is and the closer to the usable limit, the shorter the warning cycle is made, and the lower the ink level is and the further from the usable limit, the longer the warning cycle is made. Specifically, when combining high/low of the ink level with close-to/far-from the usable limit, priority between the ink level and the remaining period to the usable limit may be set by adopting a weighting coefficient between the two. For example, when the priority is given to the remaining period to the usable limit, the warning cycle of the remaining period closer to the usable limit and the lower ink level may be made shorter than the warning cycle of the remaining period further from the usable limit and the higher ink level.

In addition, various warning messages are stored in the memory storage 11 according to the remaining periods to the usable limit of the ink cartridge 150 and the ink level of the ink cartridge 150. For example, a warning message "Much ink is remained. Please use it up as soon as you can." is stored for the above case (i). A warning message "Ink is remained. Please use it up as soon as you can." is stored for the above case (ii). A warning message "A little ink is remained. Please use it up." is stored for the above case (iii).

According to the present modified example, a user can be prompted to use ink when being closer to the usable limit of the ink cartridge in a case where the ink level is high. Therefore, it is possible to consume ink efficiency by avoiding waste during the usable period.

Modified Example 4

A modified example 4 will be described hereinafter. In the above embodiment, it is determined, based on the production date, the recommended limit and the elapsed date from the production date, whether or not the recommended limit has passed. In the present modified example, the recommended limit is set according to a location where the inkjet printer 1 is placed.

In the present modified example, the memory storage 11 also stores a location table in which local codes that indicate locations and normally-usable periods are associated with each other. For example, a local code "JP" that indicates Japan and twenty-four months as the normally-usable period for Japan are associated with each other in the location table. In addition, a local code "AF" that indicates Africa and eighteen months as the normally-usable period for Africa are associated with each other in the location table.

The determiner 101 retrieves the normally-usable period of the ink cartridge 150 that is associated with a local code (e.g. the local code is input through the operation panel 12 by a user) from the location table stored in the memory storage 11, and then calculates the recommended limit of the ink cartridge 150 based on the retrieved normally-usable period and the production date retrieved wirelessly from the memory 153 of the ink cartridge 150.

It is generally assumed that ink will deteriorate early in a hot region. Therefore, according to the present modified example, the replacement recommended period is set longer (i.e. the normally-usable period is set shorter) in the hot region to generate a warning earlier. On the other hand, it is generally assumed that ink will deteriorate late in a cold region. Therefore, according to the present modified example, the replacement recommended period is set shorter (i.e. the normally-usable period is set longer) in the cold region. As the result, the recommended limit can be set adequately for the location where the inkjet printer 1 is placed according to the present modified example.

Modified Example 5

A modified example 5 will be described hereinafter. In the above embodiment, the warning generator 102 displays the warning message 204 on the operation panel 12 when the warning cycle (an integral multiple of a month) has elapsed from the last warning generation and a power-on operation of the inkjet printer 1 (or a resume from the energy-saving mode) is detected. However, the warning cycle is not limited to an integral multiple of a month, but may be set in units of days.

For example, when the warning cycle is set to forty (days), the warning generator 102 displays the warning message 204 on the operation panel 12 when forty days has elapsed from the last warning generation and a power-on operation of the inkjet printer 1 (or a resume from the energy-saving mode) is detected.

According to the present modified example, it is possible to determine whether or not the recommended limit of the ink cartridge 150 has passed by easy and simple calculation of days.

Modified Example 6

A modified example 6 will be described hereinafter. In the above embodiment, the determiner 101 determines, with respect to each of the ink cartridges 150, whether or not the recommended limit has passed based on the production date, the recommended limit and the elapsed date (time) from the production date, and the warning generator 102 displays the warning message 204 on the operation panel 12 when the warning cycle has elapsed from the last warning generation and a power-on operation of the inkjet printer 1 (or a resume from the energy-saving mode) is detected.

If all or some of the ink cartridges 150 involve the warning generation, the warnings for the ink cartridges 150 that involve the warning generation may be displayed in a single message window (a single warning screen) at once on the operation panel 12. Alternatively, the warnings for the ink cartridges 150 that involve the warning generation may be displayed sequentially on the operation panel 12 so that the closer to the usable limit, the earlier it is displayed. In addition, a user may select one of the displaying way, the warnings are displayed at once on the operation panel 12, or the warnings are displayed sequentially on the operation panel 12.

Modified Example 7

A modified example 7 will be described hereinafter. In the above embodiment, the memory storage 11 stores the replacement recommended period and the normally-usable period with respect to each of the ink cartridges 150. However, both or any one of them may beset according to preset ranks of quality.

For example, in the present modified example, the replacement recommended period and/or the normally-usable period may be set according to colors of ink. Even in a case where two or more of the ink cartridges 150 has the same color, the replacement recommended period (the normally-usable period) may be made different from each other according to their manufacturing methods. Further, the warning message (a displayed content of the warning) may be varied according to colors and/or manufacturing methods.

Modified Example 8

A modified example 8 will be described hereinafter. In the above embodiment, the determiner 101 determines, with respect to each of the ink cartridges 150, whether or not the recommended limit has passed based on the production date, the recommended limit and the elapsed date (time) from the production date. However, the determination concerning the recommended limit is not limited to that in the above embodiment.

For example, in the present modified example, the memory 153 stores a date of first use of the ink cartridge 150 (usage start date) in addition to the production date, the ink level and the warning information of the ink cartridge 150.

Here, the usage start date is a date of the first installation of the ink cartridge 150 into the main unit 2 of the inkjet printer 1.

The determiner 101 determines, with respect to each of the ink cartridges 150, whether or not the recommended limit has passed based on the production date, the recommended limit and an elapsed date (time) from the usage start date. Specifically, the recommended limit is a limit date when the normally-usable period elapses from the usage start date, and the usable limit is a date when the replacement recommended period elapses from the recommended limit According to the present modified example, the determination, whether or not the recommended limit has passed, is made in consideration of the usage start date when a package of the ink cartridge 150 is opened and then the ink cartridge 150 is installed into the main unit 2 of the inkjet printer 1. Therefore, more adequate managements of the ink cartridges 150 can be made in consideration of actual usage conditions of the ink cartridges 150.

Modified Example 9

A modified example 9 will be described hereinafter. In the above embodiment and the above modified examples, the descriptions are made by taking a combination of the inkjet printer 1 and the ink cartridge(s) 150 as an example. However, the configuration is not limited to this combination. For example, a stencil printer may be used instead of the inkjet printer 1, and an ink container(s) installed in a drum(s) may be used instead of the ink cartridge(s) 150. In this case, operations of the stencil printer may be carried out by use of tag information (a memory) attached to a stencil sheet roll. The present invention can be applied to a printer even which uses an expendable supply(-ies) such as an electro-photographic printer.

Modified Example 10

A modified example 10 will be described hereinafter. In the above modified example 4, the recommended limit is set according to a location where the inkjet printer 1 is placed. However, setting of the recommended limit is not limited to this. In the present modified example, the inkjet printer 1 (the main unit 2) further includes a temperature sensor that detects an environmental temperature (ambient temperature of the inkjet printer 1), and a temperature condition storage that stores a correspondence relation between a temperature range and the normally-usable period. The normally-usable period to be used is retrieved from the temperature condition table based on the environmental temperature detected by the temperature sensor, and then the determiner 101 determines whether or not the recommenced limit of the ink cartridge 150 has passed. According to the present modified example, the recommenced limit can be set adequately according to the environmental temperature of the ink cartridge 150 (the inkjet printer 1).

Modified Example 11

In the present modified example, a user can freely set a method for presenting (outputting [displaying]) the warning. For example, a further condition set by a user can be added to the condition for generating the warning. Here, the further condition set by a user may be that a warning will be presented to the user every two warning generations.

According to the present modified example, the warning is presented to a user in consideration of the user's setting. Therefore, detailed controls of the warning can be made while reflecting user's intension. With respect to the warning during the replacement recommended period, the warning may be omitted when plural warnings have already presented to a user and then the user input a command for omitting further warnings through the operation panel 12.

Modified Example 12

In the above embodiment and the modified examples, the warning generator 102 generates a warning (displays a warning message on the operation panel 12) when the inkjet printer 1 is powered on or resumed from its energy-saving mode (YES in step S110), but the condition for generating a warning is not limited to these. For example, the warning generator 102 may generates a warning also when, during powering-on of the main unit 2, replacement of the ink cartridges 150 is made, i.e. a new ink cartridge 150 is installed in the main unit 2.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefit of priorities under 35 U.S.C. §119 to Japanese Patent Applications No. 2014-112015, filed on May 30, 2014, and No. 2015-103422, filed on May 21, 2015, the entire contents of which are incorporated herein by reference.

What is claimed is:

1. A printer comprising:

an expendable supply replaceably installed in the printer and used in a printing operation of the printer;

a detector that detects at least one of a power-on operation of the printer, a resume operation from an energy-saving mode of the printer and an installation of a replacement expendable supply in the printer;

a determiner that determines whether or not a recommended limit of the expendable supply has passed, based on a production date or a usage start date of the expendable supply, the recommended limit set before a usable limit of the expendable supply, and an elapsed date from the production date or the usage start date;

a warning generator that generates a warning for notifying that the usable limit of the expendable supply is approaching, when the determiner determines that the recommended limit of the expendable supply has passed; and a memory storage that stores a warning cycle including a first time period and a second time period after the first time period, and a timing of a last warning generation after the recommended limit, wherein, upon determination by the determiner that the recommended limit has passed and upon detection by the detector of the power-on operation, the resume operation from the energy-saving mode, or the installation of the replacement expendable supply, the warning generator determines whether to generate a warning, wherein, in determining whether to generate a warning, the warning generator:

determines to generate a warning upon the timing of the last warning generation being not yet stored in the memory storage at the detection by the detector, or upon the timing of the last warning generation included in the first time period being already stored in the memory storage at the detection by the detector and the first time period having elapsed at the detection by the detector; and determines not to generate a warning upon the timing of the last warning generation included in the first time period being already stored in the memory storage at the detection by the detector and the first time period having not elapsed at the detection by the detector, and wherein the warning generator:

generates a warning upon determination to generate a warning; and does not generate a warning upon determination not to generate a warning.

2. The printer according to claim 1, wherein the memory storage stores the warning cycle including the first time period provided as an integral multiple of a first preset period and the second time period provided as an integral multiple of the first preset period, and a second preset period shorter than the first preset period, and in determining whether to generate a warning, the warning generator:

determines to generate a warning upon the timing of the last warning generation being not yet stored in the memory storage at the detection by the detector, or upon the timing of the last warning generation included in the first time period being already stored in the memory storage at the detection by the detector, the first time period having elapsed at the detection by the detector, and the second preset period having elapsed in the second time period at the detection by the detector; and determines not to generate a warning upon the timing of the last warning generation included in the first time period being already stored in the memory storage at the detection by the detector, the first time period having elapsed at the detection by the detector, and the second preset period having not elapsed in the second time period at the detection by the detector.

3. The printer according to claim 2, wherein the warning cycle is set according to an elapsed period from the recommended limit so that the closer to the usable limit, the shorter the warning cycle is made.

4. The printer according to claim 2, wherein the warning cycle is set so that the larger a usable remaining amount of the expendable supply is, the shorter the warning cycle is made.

5. The printer according to claim 2, wherein the memory storage further stores a location table in which local codes that indicate locations and normally-usable periods of the expendable supply are associated with each other, a normally-usable period is a period from the production date or the usage start date to the recommended limit, and the determiner retrieves the normally-usable period that is associated with a local code from the location table, and determines whether or not the recommended limit has passed based on the normally-usable period and the production date or the usage start date.

6. The printer according to claim 1, wherein the warning cycle is set according to an elapsed period from the recommended limit so that the closer to the usable limit, the shorter the warning cycle is made.

7. The printer according to claim 1, wherein the warning cycle is set so that the larger a usable remaining amount of the expendable supply is, the shorter the warning cycle is made.

8. The printer according to claim 1, wherein the memory storage further stores a location table in which local codes that indicate locations and normally-usable periods of the expendable supply are associated with each other, a normally-usable period is a period from the production date or the usage start date to the recommended limit, and the determiner retrieves the normally-usable period that is associated with a local code from the location table, and determines whether or not the recommended limit has passed based on the normally-usable period and the production date or the usage start date.

9. The printer according to claim 1, wherein the timing is stored in the memory storage as a date, and each of the first time period and the second time period of the warning cycle is provided as an integral multiple of a unit of time having a period longer than one day.

10. The printer according to claim 1, wherein the expendable supply is contained in a replaceable housing, the recommended limit and the usage limit being based upon a time-dependent characteristic of the expendable supply within the housing.

11. The printer according to claim 1, wherein the expendable supply is contained in a replaceable housing, the warning cycle being based upon an amount of the expendable supply within the housing and upon a time dependent characteristic of the expendable supply within the housing.

12. A printer configured to carry out a printing operation and including an expendable supply that is replaceably installed in the printer and is used in the printing operation, the printer comprising:

a detector that detects at least one of a power-on operation of the printer, a resume operation from an energy-saving mode of the printer and an installation of a replacement expendable supply in the printer;

a determiner that determines whether or not a recommended limit of the expendable supply has passed, based on a production date or a usage start date of the expendable supply, the recommended limit set before a usable limit of the expendable supply, and an elapsed date from the production date or the usage start date;

a warning generator that generates a warning for notifying that the usable limit of the expendable supply is approaching, when the determiner determines that the recommended limit of the expendable supply has passed; and a memory storage that stores a warning cycle that is an interval between two warning generations and is provided as an integral multiple of a first preset period, a second preset period shorter than the first preset period, and a timing of a last warning generation after the recommended limit, wherein, when the determiner determines that the recommended limit has passed and the power-on operation, the resume operation from the energy-saving mode or the installation of the replacement expendable supply is detected by the detector, the warning generator generates a warning [1] when the timing of the last warning generation is not yet stored in the memory storage, or [2] when the timing of the last warning generation is already stored in the memory storage, the warning cycle has elapsed from the last warning generation and the second preset period has elapsed in the first preset period at a current timing.

* * * * *